United States Patent [19]

Nilsson

[11] Patent Number: 4,692,214

[45] Date of Patent: Sep. 8, 1987

[54] APPARATUS FOR PRODUCING MECHANICAL PULP WITH A REFINER HAVING ITS DRIVE SHAFT CONNECTED TO A STEAM TURBINE OUTPUT SHAFT

[75] Inventor: Bengt Nilsson, Skognall, Sweden

[73] Assignee: Kamyr AB, Karlstad, Sweden

[21] Appl. No.: 665,910

[22] Filed: Oct. 29, 1984

[51] Int. Cl.[4] ..... D21C 11/06; D21D 1/00

[52] U.S. Cl. ..... 162/261; 60/648; 162/23; 162/28; 162/46; 162/47; 241/244

[58] Field of Search ..... 162/26, 23, 28, 47, 162/46, 68, 249, 250; 241/28, 244; 60/648

[56] References Cited

U.S. PATENT DOCUMENTS

| | | | |
|---|---|---|---|
| 3,627,629 | 12/1971 | Miller | 162/26 |
| 3,856,214 | 12/1974 | Kaltenbach et al. | 241/34 |
| 4,231,842 | 11/1980 | Ojala | 162/47 |
| 4,270,357 | 6/1981 | Rossi et al. | 60/648 |
| 4,272,962 | 6/1981 | Viscovitch et al. | 60/648 |
| 4,359,871 | 11/1982 | Strass | 60/648 |

FOREIGN PATENT DOCUMENTS

| | | | |
|---|---|---|---|
| 506344 | 9/1930 | Fed. Rep. of Germany . | |
| 520161 | 2/1931 | Fed. Rep. of Germany | 04001960/DEX |
| 2453935 | 12/1980 | France | 162/47 |
| WO84/03526 | 9/1984 | PCT Int'l Appl. . | |
| 67672 | 3/1926 | Sweden . | |
| 75634 | 4/1927 | Sweden . | |
| 421137 | 8/1979 | Sweden . | |
| 82028689 | 5/1982 | Sweden . | |
| 1266898 | 3/1972 | United Kingdom . | |

OTHER PUBLICATIONS

Hester et al, "Heat Pump Systems for the Pulp & Paper Ind.", *TAPPI*, Jul. 1980, vol. 63, No. 7, p. 67.

Baldus et al, "Evaluation of Power and Steam Generating Alternatives in Kraft Mills", *TAPPI*, Sep. 1978, vol. 61, No. 9, p. 77.

Lahner et al, Pulp and Paper Magazine, Jun., 1981 (reprint of Jul., 1982), entitled "High TMP Refiner Consistencies . . . ".

Edde et al, TAPPI Journal, Sep., 1984, vol. 67, No. 9. pp. 86–89, "Process and Economic Evaluation . . . ".

Pakulski, Paper Industry Magazine, Nov. 1977 (reprint 1978), "The Case for TMP at Consolidated Papers".

Beaulieu et al, Pulp and Paper *Canada Magazine*, Mar., 1977 (Sep. 1977 reprint) "Domtar Installs TMP System . . . ".

*Koppers* Brochure, Bulletin 8006, Jul., 1980 "Thermal-Mechanical Pulping Systems . . . ".

Blumberg; "TMP Clean Steam Recovery for Paper Drying"; TAPPI Journal, vol. 60, No. 6, Jun., 1983, pp. 69–70.

Walker et al; "Heat Recovery from TMP . . . "; Pulping Processes, 1981, pp. 154–156, (paper presented Jan. 15–17, Atl. Ga.).

Helke, Thesis for Designing of 6 MW Turbine Driven by Discharge Steam from "Thermo-Mechanical Pulp in Cooler", 1980–1981.

*Primary Examiner*—Steve Alvo

*Attorney, Agent, or Firm*—Nixon & Vanderhye

[57] ABSTRACT

In the production of mechanical pulp, a refiner (defibrator) is driven by a steam turnine. The steam supply for the turbine comprises process steam generated in the refiner during the refining action, which steam is preferably passed through a reboiler. Some make-up energy is necessary to provide all of the power for driving the refiner, the make-up energy being preferably provided by clean steam from an accessory source introduced to the turbine by a steam ejector. A portion of the process steam, and the steam discharge from the turbine, can be used for presteaming the chips (comminuted cellulosic fibrous material) before introduction into the refiner. Any condensate from the turbine may be fed to the reboiler. Reduction gears are provided between the turbine and the refiner drive shaft so that the refiner is driven at optimum rpm for the particular material being treated. A wide variety of other structures, such as a mechanical steam compressor, and hydraulic units, can be utilized to obtain optimum desired characteristics.

14 Claims, 8 Drawing Figures

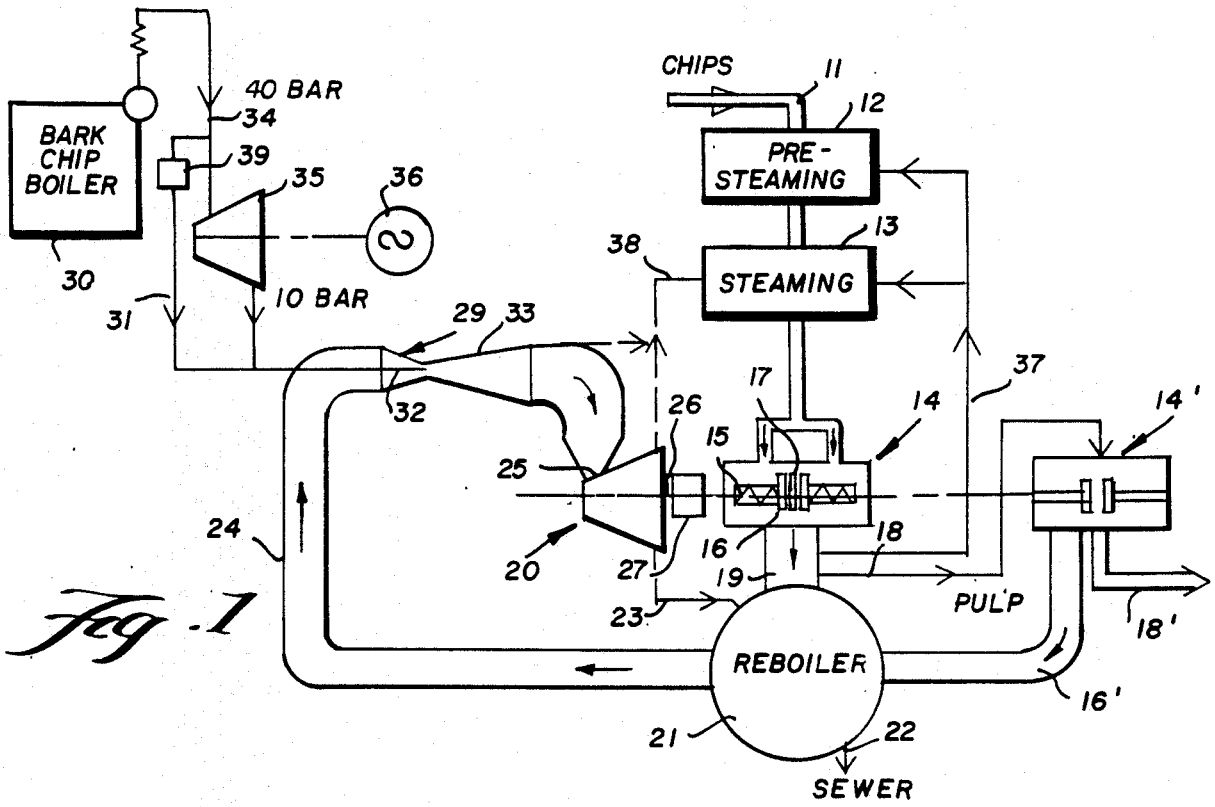
Fig. 1
Fig. 2
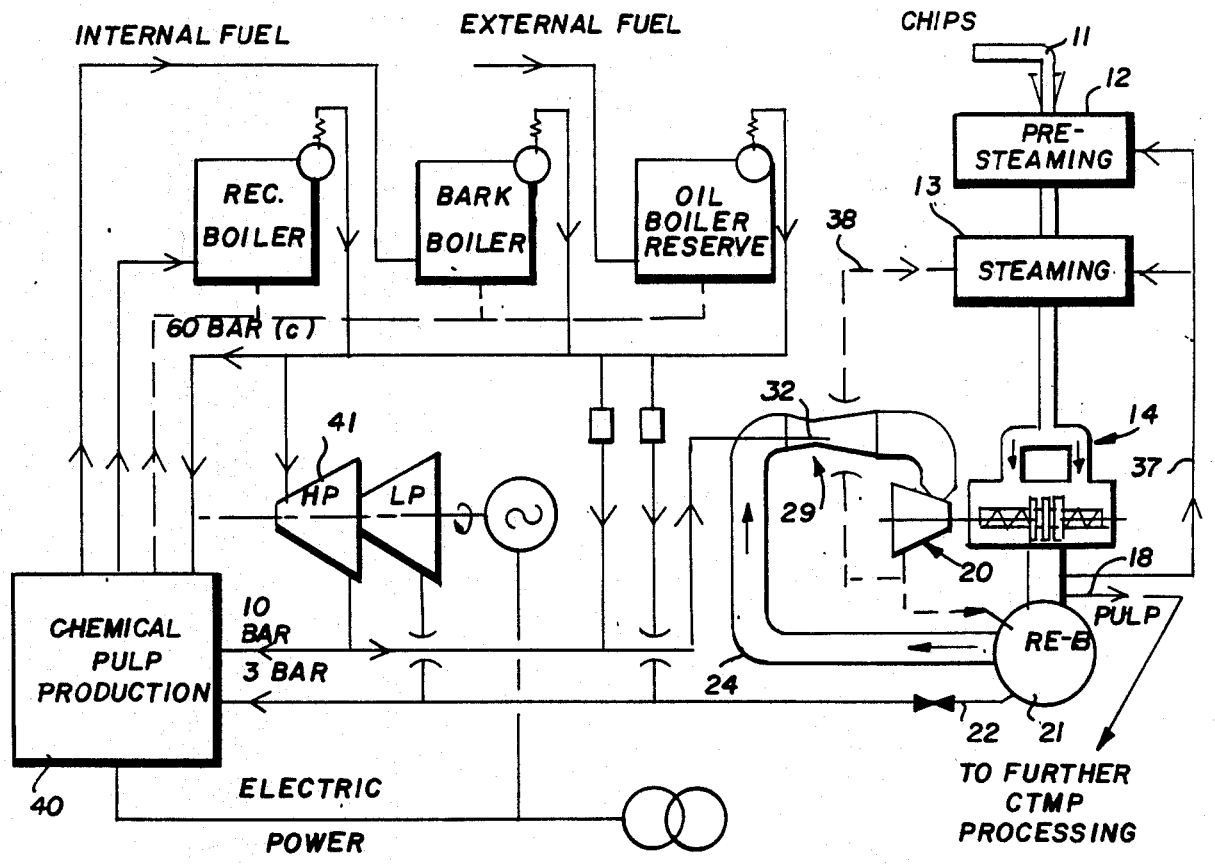

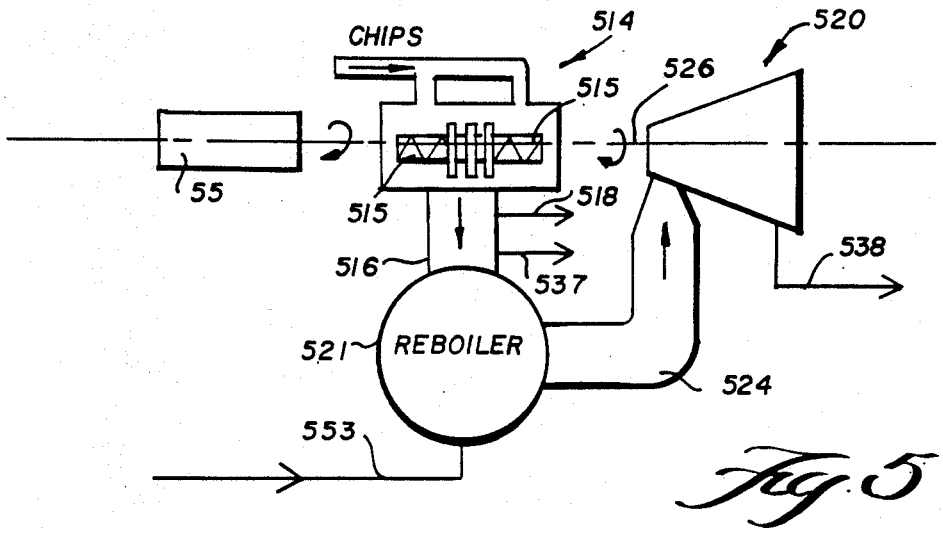
Fig. 5
Fig. 6
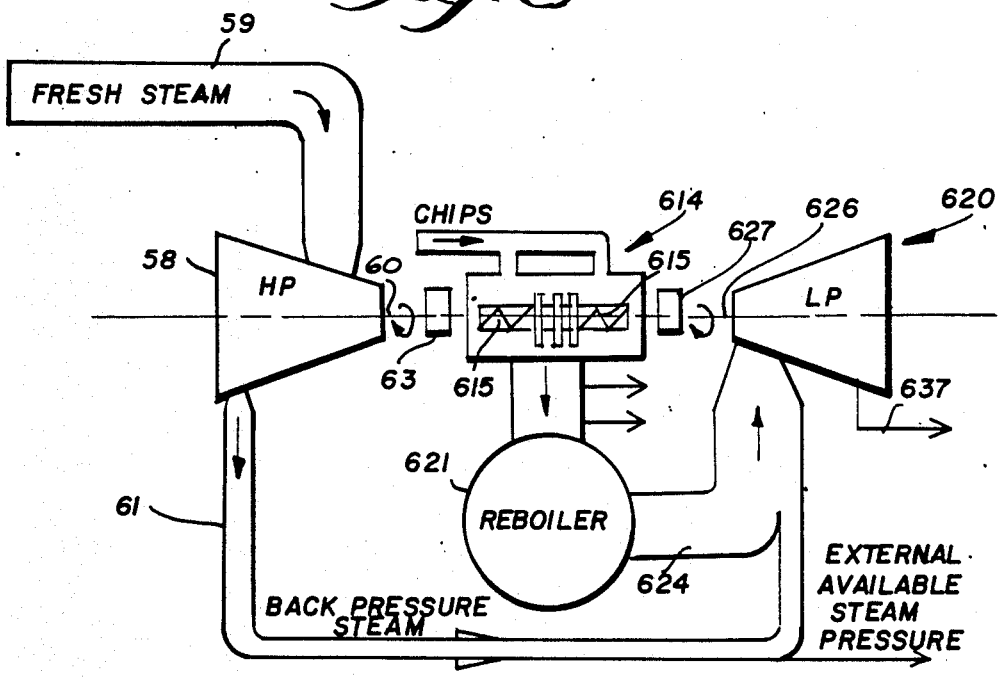

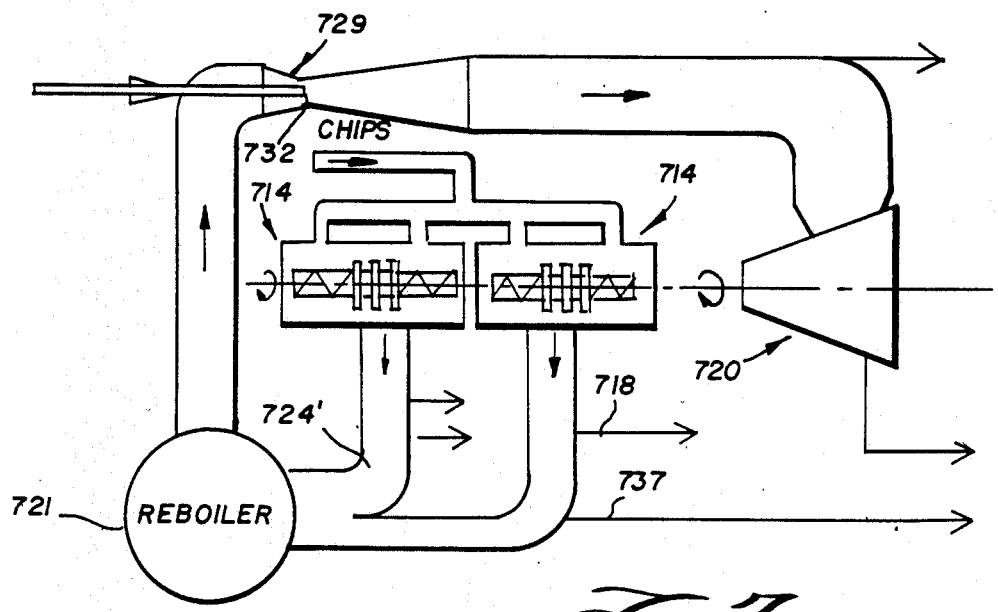
Fig. 7
Fig. 8
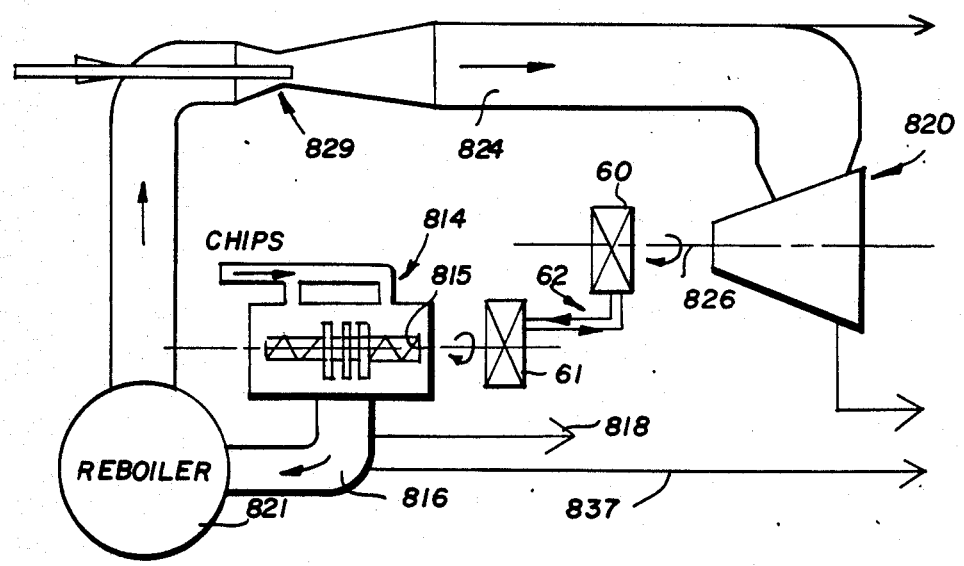

APPARATUS FOR PRODUCING MECHANICAL PULP WITH A REFINER HAVING ITS DRIVE SHAFT CONNECTED TO A STEAM TURBINE OUTPUT SHAFT

BACKGROUND AND SUMMARY OF THE INVENTION

The production of mechanical pulps is of increasing interest since a higher yield can be obtained from a given amount of raw material utilizing mechanical pulping processes as compared to chemical pulping processes. Mechanical pulping, in general, refers to refiner mechanical pulping (RMP), thermomechanical pulping (TMP), chemimechanical pulping (CMP), and chemithermomechanical pulping (CTMP) and board pulping. In each case a refiner (defibrator) is utilized as one of the basic components for breaking down the chips into progressively smaller bundles in a fibrillation process. Despite the high yields available for mechanical pulps, in many areas of the world the production of such pulps is not economical because of the energy intensive nature of the fibrillation process. Typically the refiner is driven with an electrical motor, and where electricity costs are high it is not economically feasible to utilize mechanical pulping processes.

According to the present invention, a method and apparatus are provided which allow mechanical pulping to be economically feasible under a wider range of circumstances than is the case presently. According to the invention, advantage is taken of the fact that during the fibrillation process, water in the chips and liquid that is pumped into the refiner during the refining process evaporates as a result of the frictional heat generated in the refiner, to produce process steam which exits with the pulp. In conventional refiners, an amount, 30–50%, of the process steam usually inherently vents out of the refiner inlet. However the majority of the process steam is discharged from the refiner along with the pulp, and typically is passed to a centrifugal separator where the steam is separated from the pulp. In some refining systems, the steam which vents out of the refiner inlet is combined with the pulp and steam from the pulp outlet and the combined steam is passed to a centrifugal separator. In such systems practically all steam generated in the refiner is available as one stream after the centrifugal separator and at a pressure practically equal to that prevailing in the refiner.

The steam that is vented off the centrifugal fiber separator typically contains impurities such as volatile components of the wood. In a typical system this steam is fed to a heat exchanger (often referred to as reboiler or steam transformer) where the process steam is condensed thereby providing heat for the evaporation of boiler feed water and clean steam is produced. Typically this steam is used for drying paper or pulp and reduces the demand for steam produced in boilers burning oil, coal, wood wastes, etc.

According to the present invention, the steam produced in the reboiler is used to drive a steam turbine which is operatively connected to the drive shaft for the refiner. If desired, a portion of the process steam itself may be utilized to effect presteaming of the chips before they are fed to the refiner, and additionally the steam discharge from the turbine may be utilized to effect presteaming. Where the turbine is of the condenser type, the condensate is used as feed water to the reboiler.

A number of advantages ensue from the practice of the invention. By the practice of the invention it is possible to provide the main parts of the energy (typically 75–85%) that is necessary to run the refiner from the process steam itself. Therefore only 15–25% of the energy typically necessary to power the refiner need be provided from an accessory source, such an electric motor, or such as from steam generated by the burning of oil, coal, bark or like waste products. Thus the production of mechanical pulps is economically feasible even in countries where electrical costs are high. Further, according to the invention it is possible to more precisely control the refiner speed so that it is optimum for the particular material being treated thereby enhancing pulp quality.

In the practice of the invention, a wide variety of structures may be utilized for adding the additional (approximately 15–25%) energy necessary to power the refiner. For instance a steam ejector may introduce steam under pressure from an accessory source to the turbine to supplement the steam from the reboiler. Alternatively, a mechanical steam compressor may be provided between the reboiler and the turbine. The mechanical steam compressor may be driven by an electric motor; or it may be driven by the turbine output shaft itself, and an additional supply of steam introduced between the mechanical steam compressor and the turbine. Another alternative is to provide the steam turbine as a low pressure turbine and additionally provide a high pressure turbine operatively connected to the refiner drive shaft, with fresh steam led to the high pressure turbine, and then the discharged steam from the high pressure turbine being added to the steam from the reboiler to the low pressure turbine. Still another modification is to provide an electrical motor directly connected to the refiner drive shaft, in this case the motor only being required to provide about 15–25% of the power to the refiner.

The turbine is preferably connected to the refiner through reduction gearing means. In this way the refiner rpm can be precisely controlled for optimum conditions. Alternatively, the turbine can drive a hydraulic pump, which in turn drives a hydraulic motor connected to the refiner drive shaft. The turbine, and accessory components, can be utilized to drive not just one refiner, but rather a plurality of refiners connected in parallel or in series.

It is the primary object of the present invention to provide a method and apparatus for the economical production of mechanical pulps. This and other objects of the invention will become clear from an inspection of the detailed description of the invention, and from the appended claims.

BRIEF DESCRIPTION OF THE DRAWINGS

FIG. 1 is a schematic view of an exemplary mechanical pulp production plant (e.g. a TMP plant) utilizing the apparatus according to the present invention;

FIG. 2 is a schematic view of a combined sulphate mill and CTMP plant utilizing the apparatus according to the invention; and FIGS. 3 through 8 are various modifications of apparatus according to the present invention for utilizing process steam from one or more refiners as the main energy source for powering the refiners.

DETAILED DESCRIPTION OF THE DRAWINGS

Figure 3:
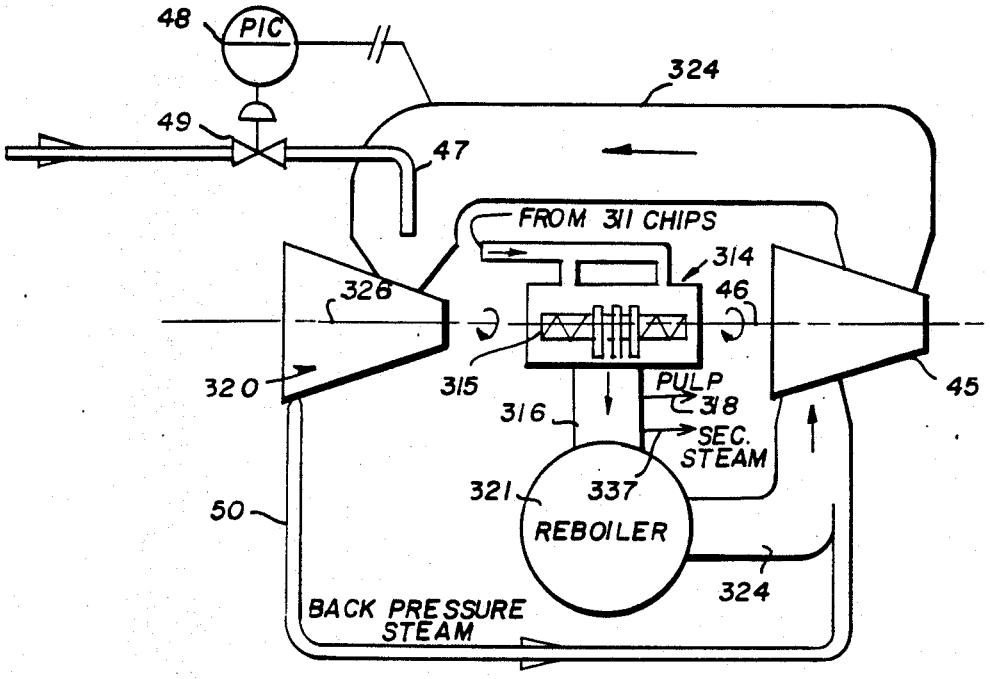

FIG. 1 schematically illustrates typical components of a mechanical pulping plant which utilizes the teachings according to the invention. Chips, or like comminuted cellulosic fibrous materials, are led from conduit 11 to steaming vessels 12 and 13, and ultimately to a conventional refiner (defibrator) 14. The refiner 14 may be any suitable conventional pressurized refiner, and typically has at least one drive shaft 15 operatively connected to a rotating element (refiner plate) 16 which cooperates with like plates (e.g. 17) which are stationary or counter-rotating, to effect fibrillation. Typically, the chips after passing through steamer 13 having a consistency of about 50 percent solids (that is they are in a liquid slurry that is approximately half water), and additional water is usually added to the refiner so that the consistency of the slurry in the refiner 14 is typically about 20–50 percent. As a result of the frictional heat generated during the fibrillation process, a considerable amount of the water in the pulp is evaporated producing what is called "process steam", and less than 10% of the power supplied to the refiner 14 actually performs the difibration.

Pulp is operatively discharged from refiner 14 in line 18, while process steam is discharged in line 19. To effect separation between the pulp and the process steam, a conventional centrifugal separator (not shown), or like gas-slurry separating device, may be employed directly connected to the refiner 14, with discharges 18 and 19 from that separator.

The process steam in discharge 19 is used to drive a conventional steam turbine 20, which may be of the condenser type, or a counterpressure type. While the process steam can, under some circumstances, be utilized to drive the turbine 20 directly, since the process steam has a number of contaminants therein, it is desirable to pass it through a heat exchanger so that only clean steam is fed to the turbine 20. A typical suitable heat exchanger comprises a conventional reboiler (steam transformer) 21. The dirty condensate 22 from the reboiler 21 may be sewered, or returned to the chips conduit 11 to provide slurrying liquid for the chips. Where the turbine 20 is of the condenser type, condensate in line 23 is fed to reboiler 21.

In a typical RMP or TMP process, a plurality of refiners 14, 14', etc. will be provided, connected in series. The pulp in discharge line 18 is the feed material to inlet of the second refiner 14', and the process steam discharged in line 16' is fed to the reboiler 21, while the pulp in pulp discharge 18' is further treated to produce the final pulp desired, or for paper making or the like. Water would typically be added at the refiner 14'.

Clean steam from the reboiler 21 is passed through conduit 24 to the steam inlet 25 to the turbine 20. Output shaft 26 from the turbine 20 is operatively connected to the drive shaft 15 of the refined 14. Typically this is accomplished utilizing reduction gearing means 27 since the output shaft 26 typically turns at a greater rpm than is desired to effect refining. By utilizing a suitable gear reduction means 26, the rpm of the refiner 14 may be optimized depending upon the particular chips being treated. This should be compared to the conventional situation where an electrical motor drives the refiner at only a single speed (typically 1500 rpm in Europe and 1800 rpm in the United States). By suitable selection of turbine 20 and reduction gearing means 27, the rpm of the refiner may vary greatly from the 1500–1800 rpm range, and is optimized.

While the process steam is capable of providing approximately 75–85% of the energy necessary to power the refiner 14, additional energy input is required. In FIG. 1 this additional energy input is provided in a simple and effective manner utilizing a conventional steam ejector 29 which increases the pressure of the steam being supplied from the reboiler 21 to the turbine 20. Steam for the ejector 29 is most suitably provided by utilizing a bark or chip boiler 30, or like boiler for burning solid or liquid fuel. The steam from the boiler 30 is passed directly through a first line 31, if suitable via a pressure reduction stage 39, to the nozzle 32 of the steam ejector 29, properly positioned with respect to diffuser 33, and preferably a portion of the steam from boiler 30 is passed to line 34 and turbine 35 to be used to power generator 36, with the steam discharge from the turbine 35 also passing to the nozzle 32.

As illustrated in FIG. 1, it is also desirable to effect the steaming in steamers 12, 13 utilizing a portion of the process steam, and the steam discharged from the turbine 20. Discharge line 37 from the refiner 14 diverts a portion of the process steam directly to the steamers 12, 13, while the discharged steam in line 38 from the turbine 20 (when the turbine 20 is of the counterpressure type) is led to steamer 13.

In FIG. 2, structures comparable to those in the FIG. 1 embodiment are illustrated by the same reference numeral.

The invention is, of course, not limited to the production of RMP and TMP, but rather may be utilized for facilitating the production of any mechanical pulp. FIG. 2 schematically illustrates the utilization of the apparatus according to the invention for the production of CTMP. The pulp in pulp discharge 18 is led to further processing stations, such as shown in copending U.S. patent application Ser. No. 543,847 filed Oct. 20, 1983, part of the steam generated in the reboiler is through line 22 fed to the chemical pulp production plant 40, additional steam for ejector nozzle 32 is provided from the steam discharged from high pressure turbine 41, and the components are otherwise interconnected as illustrated in FIG. 2.

As illustrated in FIG. 2, the steam turbine 20 is integrated into the CTMP production plant as a whole.

A number of different modifications may be provided for the basic structure illustrated in FIG. 1 in order to facilitate the ultimate objective of providing the majority of the power for the refiner(s) during mechanical pulping by utilizing process steam. In the FIGS. 3 through 8 embodiments of the apparatus, structures corresponding to those in the FIG. 1 embodiment are illustrated by the same reference numeral only preceded by a "3" (in the case of FIG. 3), "4" (FIG. 4), "5" (FIG. 5), "6" (FIG. 6), "7" (FIG. 7), or "8" (FIG. 8), respectively.

In the FIG. 3 embodiment, the steam in conduit 24 is compressed so as to provide a higher degree of steam recovery for the driving of the turbine 320. In this embodiment, the turbine 320 is of the counterpressure type, and a mechanical steam compressor 45 is operatively disposed in the conduit 324. The drive shaft 46 for the mechanical steam compressor 45 is operatively connected to the refiner shaft 315 and the turbine shaft 326. Additional energy is provided in the form of make-up steam introduced through pipe 47 into conduit 324 just prior to the turbine 320. The amount of make-up steam introduced is controlled by the pressure controller 48 which is operatively connected to valve 49 in the pipe 47. Back pressure steam in conduit 50 from turbine 320 is fed to the steam conduit 324 prior to the compressor 45.

Figure 4:
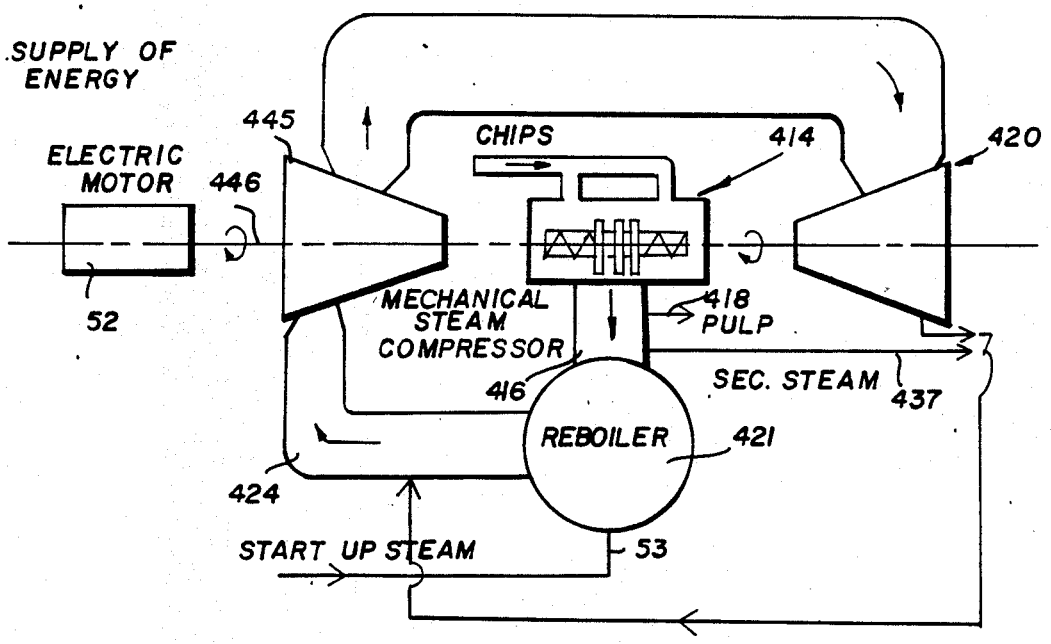

The FIG. 4 embodiment is very similar to the FIG. 3 embodiment except that the power for the mechanical steam compressor 445 is provided by an electric motor 52. Note also in this embodiment that steam may be provided in conduit 53 to the reboiler 421 to provide start-up for the system.

In the FIG. 5 embodiment, the additional energy (approximately 15–25%) necessary to power the refiner 514 is provided by an electrical motor 55 operatively connected directly to the refiner drive shaft 515. Suitable gearing means (not shown) are preferably provided between motor 55 and shaft 515, and between turbine shaft 526 and refiner shaft 515. Of course the refiner 514 may have a plurality of drive shafts 515, with the turbine shaft 526 connected to one of them (right hand side in FIG. 5) and the electrical motor 55 operatively connected to the other (left hand side in FIG. 5) so that the speeds need not be matched.

In the FIG. 6 embodiment, the additional energy necessary to power the refiner 614 is provided utilizing a high pressure turbine 58, the turbine 620 being a low pressure turbine. The high pressure turbine 58 is of the counterpressure type and is provided with fresh steam from conduit 59 to drive output shaft 60, while back pressure steam passes in conduit 61 to the steam conduit 624 from reboiler 621. Gear reduction means 627, 63 are provided for operatively connecting the turbine 620, 58, respectively to the drive shaft or shafts 615 of the refiner 614. Alternatively, in this embodiment two in-parallel (or in series) refiners 614 may be provided, as illustrated in the FIG. 7 embodiment, one of the refiners driven by shaft 60, and the other by shaft 626.

The FIG. 7 embodiment is very similar to the FIG. 1 embodiment except that parallel refiners 714, 714' are provided operatively connected via process steam conduits 724, 724' to the reboiler 721.

The FIG. 8 embodiment is very similar to the FIG. 1 embodiment except that the means for operatively connecting the turbine 820 to the refiner drive shaft 815 comprises a hydraulic drive system including a hydraulic pump 60 driven by the output shaft 826 from the turbine 820, and a hydraulic motor 61 directly connected to the shaft 815 and driven by hydraulic fluid supplied from the pump 60 through lines 62. Start-up steam, as well as make-up steam, is provided through the ejector 829.

Utilizing the apparatus heretofore described, it is possible to practice a method of producing a mechanical pulp (such as RMP, CTMP, etc.) from a liquid slurry of comminuted cellulosic fibrous material in an efficient and cost-effective manner utilizing a defibrator 14 and a steam turbine 20. The method comprises the following steps: (a) Introducing slurry into defibrator 14 from conduit 11. (b) Driving the drive shaft 15 of the defibrator 14 to cause the defibrator plates 16, 17 to act on the material to effect fibrillation. Less than 10% of the energy consumed by the defibrator 14 actually effects fibrillation, the vast majority of the energy taking the form of frictional heat which generates process steam from the liquid of the slurry in the refiner 14. (c) Discharging mechanical pulp (which is usually further acted upon by other refiners to produce RMP, or in other processing steps to produce CTMP, or the like) into line 18. (d) Discharging process steam from the defibrator 14 into line 19. And, (e) utilizing the energy from the process steam, as well as additional energy input that may be necessary (approximately 15–25% of the total energy to power the defibrator 14 being required), to drive the turbine 20, which in turn drives the defibrator 14, providing all the energy necessary to practice step (b).

For the production of TMP, (or CTMP) a portion of the process steam is passed in line 37 to the presteaming and steaming stations 12, 13, and discharged steam from the turbine 20 passes in line 38 to the steamer 13.

Step (e) is preferably practiced by passing the process steam through a heat exchanger (reboiler 21) to produce clean steam which is then fed (via conduit 24) to the turbine 20, and condensate in line 23 passes from turbine 20 to be used as feed water for the reboiler 21. The additional energy input is preferably provided by additional steam introduced through nozzle 32 of steam ejector 29, and the turbine 20 and gear reduction means 27 are selected so that the rpm of the defibrator 14 is optimized for the given material being pulped. The process steam in conduit 19 passing to reboiler 21 typically is at a pressure between about 0.5 and 10 bars (gauge), and the dirty condensate from reboiler 21 in line 22 is either sewered or used to slurry additional chips to be treated or pulp produced.

It will thus be seen that according to the present invention a method and apparatus have been provided which facilitate the efficient and cost-effective production of mechanical pulps. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for producing mechanical pulp comprising:

a refiner having a drive shaft operatively connected to at least one rotatable refining element;

separating means for separating steam from refined material;

a process steam discharge means for discharging process steam from said separating means;

a pulp discharge means for discharging refined material from said separating means;

a steam turbine having a steam input and a rotating output shaft;

means for connecting said process steam discharge means to said steam turbine input, comprising reboiling means; and means for connecting said turbine output shaft and said refiner drive shaft.

2. Apparatus as recited in claim 1 wherein said means for connecting said turbine output shaft and said refiner drive shaft comprises reduction gearing means for reducing the speed of rotation of said steam turbine output shaft so that said refiner drive shaft is rotated at the optimum rpm for refining of the particular material being refined.

3. Apparatus as recited in claim 1 further comprising a steaming vessel operatively connected to said refiner for steaming material before the material is fed to said refiner; and further comprising conduit means for leading a portion of the process steam from said process steam discharge means to said steaming means for effecting steaming of the material before entering said refiner.

4. Apparatus as recited in claim 1 further comprising means for passing condensate from said steam turbine to said reboiling means.

5. Apparatus as recited in claim 1 further comprising steam ejector means operatively connected said reboiling means and said steam turbine for adding steam in addition to said process steam, and at a higher pressure than said process steam, to said steam turbine steam input.

6. Apparatus as recited in claim 1 further comprising mechanical steam compressing means operatively connected between said reboiling means and said steam turbine for compressing said process steam.

7. Apparatus as recited in claim 6 further comprising an electric motor for driving said mechanical steam compressing means.

8. Apparatus as recited in claim 6 further comprising a drive shaft for said mechanical steam compressing means, said drive shaft for said mechanical steam compressing means operatively connected to said refiner drive shaft; and further comprising means responsive to the pressure of steam being fed from said mechanical steam compressing means to said steam turbine for supplementing the amount of steam provided to the steam input to said steam turbine so that said steam turbine powers said refiller and said mechanical steam compressor.

9. Apparatus as recited in claim 1 further comprising an electric motor operatively connected to said refiner drive shaft for cooperating with said steam turbine for powering said drive shaft, the amount of energy supplied by said electric motor to said refiner drive shaft being significantly less than the amount of energy provided by said steam turbine.

10. Apparatus as recited in claim 1 wherein said steam turbine comprises a low pressure turbine, and further comprising a high pressure steam turbine operatively connected to said refiner drive shaft; a high pressure fresh steam input to said high pressure turbine; and a low pressure steam discharge from said high pressure turbine, said low pressure steam discharge operatively connected to said steam input for said low pressure turbine.

11. Apparatus as recited in claim 10 wherein said means for connecting said low pressure turbine to said refiner drive shaft comprises first reduction, gearing means, and wherein said means for connecting said high pressure turbine to said refiner drive shaft comprises second reduction gearing means.

12. Apparatus as recited in claim 1 further comprising: a steam outlet from said steam turbine; steaming means for steaming material prior to the material being fed to the refiner for refining; and means operatively connecting said steam outlet from said steam turbine to said steaming means.

13. Apparatus as recited in claim 1 wherein said means for connecting said steam turbine and said refiner drive shaft comprises a hydraulic pump driven by said steam turbine output shaft, and a hydraulic motor driving said refiner drive shaft, said hydraulic pump operatively connected to said hydraulic motor.

14. Apparatus as recited in claim 1 further comprising at least one other refiner having a drive shaft, said drive shaft of said at least one other refiner also being operatively connected to said steam turbine output shaft.

* * * * *